US011912322B2

(12) United States Patent
Ross et al.

(10) Patent No.: US 11,912,322 B2
(45) Date of Patent: Feb. 27, 2024

(54) METHOD, SYSTEM, COMPUTER-READABLE MEDIUM COMPRISING SOFTWARE CODE FOR ESTIMATING PARAMETERS OF RAILWAY TRACK CIRCUITS, AND RELATED TRACK CIRCUIT

(71) Applicant: ALSTOM Transport Technologies, Saint-Ouen-sur-Seine (FR)

(72) Inventors: John Ross, Melbourne, FL (US); Jeffrey Fries, Grain Valley, MO (US)

(73) Assignee: ALSTOM Transport Technologies, Saint-Ouen-sur-Seine (FR)

( * ) Notice: Subject to any disclaimer, the term of this patent is extended or adjusted under 35 U.S.C. 154(b) by 668 days.

(21) Appl. No.: 17/123,055

(22) Filed: Dec. 15, 2020

(65) Prior Publication Data

US 2022/0185351 A1 Jun. 16, 2022

(51) Int. Cl.

| | |
|---|---|
| ***B60W 60/00*** | (2020.01) |
| ***B61L 29/30*** | (2006.01) |
| ***B61L 15/00*** | (2006.01) |
| ***B61L 29/32*** | (2006.01) |

(52) U.S. Cl.

CPC ..... *B61L 29/30* (2013.01); *B61L 15/009* (2013.01); *B61L 15/0072* (2013.01); *B61L 29/32* (2013.01)

(58) Field of Classification Search

CPC ..... B60W 60/0015; B60W 30/095
USPC ..... 701/23
See application file for complete search history.

(56) References Cited

U.S. PATENT DOCUMENTS 3,660,731 A * 5/1972 Darrow ..... B61L 1/187 361/186
4,307,860 A * 12/1981 Kuhn ..... B61L 29/286 246/128
4,763,267 A * 8/1988 Knight ..... G06F 11/1633 246/131
4,787,581 A * 11/1988 Dobler ..... B61L 1/161 246/247

(Continued)

FOREIGN PATENT DOCUMENTS

AU 2020267200 A1 * 6/2021 ..... B61L 1/188
CN 210376539 U * 4/2020

(Continued)

*Primary Examiner* — Richard A Goldman
(74) *Attorney, Agent, or Firm* — Soquel Group LLC

(57) ABSTRACT

Estimating electrical parameters of a track circuit including a transmitter, a receiver, and a track section between the transmitter and receiver. The transmitter outputs, over the track section towards the receiver, a signal including a data packet part, and the signal received by the receiver is decoded to determine the data packet received. Simulated signals are generated, via a predetermined software model including parameters of the track circuit, by varying an actual value input for the model parameters, each signal generated corresponding to actual values input for the parameters. Each simulated signal is compared with the signal received at a receiver until finding a part of a simulated signal that matches a corresponding part of the signal received at a receiver. The actual parameter values corresponding to the simulated signal that match the signal received at the receiver are estimated as the actual parameters of the track circuit.

19 Claims, 5 Drawing Sheets

(56) References Cited

U.S. PATENT DOCUMENTS 4,792,870 A * 12/1988 Pinson ..... G11B 21/083 360/78.09
4,932,615 A * 6/1990 Frazier ..... B61L 1/20 324/225
10,778,271 B1 * 9/2020 Casulli ..... B61L 27/53
11,148,690 B2 * 10/2021 Fries ..... B61L 1/20
11,235,790 B2 * 2/2022 Corbo ..... B61L 29/226
2003/0010872 A1 * 1/2003 Lewin ..... B61L 25/025 246/122 R
2009/0173842 A1 * 7/2009 Lawson ..... B61L 1/20 246/34 R
2012/0232813 A1 * 9/2012 Lawson ..... B61L 1/181 702/58
2013/0228656 A1 * 9/2013 Ireland ..... A63H 19/00 246/122 A
2013/0284859 A1 * 10/2013 Polivka ..... B61L 27/60 246/34 R
2015/0192636 A1 * 7/2015 Fries ..... B61L 29/286 324/511
2015/0367872 A1 * 12/2015 Plotnikov ..... B61L 3/18 246/121
2016/0090113 A1 * 3/2016 Nagrodsky ..... B61L 1/18 246/34 R
2017/0021846 A1 * 1/2017 Cipollone ..... B61L 25/023
2017/0197646 A1 * 7/2017 Shubs, Jr. ..... B61L 27/40
2018/0065650 A1 * 3/2018 Plotnikov ..... B61L 3/08
2020/0156674 A1 * 5/2020 Qin ..... G06F 18/23213
2020/0156678 A1 * 5/2020 Moss ..... H04B 10/25891
2020/0307660 A1 * 10/2020 Fries ..... B61L 1/188
2021/0146972 A1 * 5/2021 Ross ..... B61L 15/0036
2021/0146980 A1 * 5/2021 Corbo ..... B61L 1/16
2021/0396199 A1 * 12/2021 Zielinski ..... F02D 41/3845
2022/0185351 A1 * 6/2022 Ross ..... B61L 15/009
2022/0355841 A1 * 11/2022 Fries ..... G01N 27/041

FOREIGN PATENT DOCUMENTS

CN 113515876 A * 10/2021
EP 3653465 A1 * 5/2020 ..... B61K 9/08

* cited by examiner

METHOD, SYSTEM, COMPUTER-READABLE MEDIUM COMPRISING SOFTWARE CODE FOR ESTIMATING PARAMETERS OF RAILWAY TRACK CIRCUITS, AND RELATED TRACK CIRCUIT

FIELD OF THE INVENTION

The present invention relates to a method, a system and a computer-readable medium including software code for estimating parameters of railway track circuits, and to a related track circuit.

BACKGROUND OF THE INVENTION

In the field of railway applications, it is known the use of track circuits, namely systems performing critical safety functions in the monitoring and management of traffic over a railway network. In particular, rail track circuits are primarily used to detect whether a train is present on a track section; they can be also used to detect broken rails within the track section, and/or to transmit signal aspect information through the rails, for example to communicate movement authorities of transiting trains.

To this end, track circuits use electrical signals applied to the rails and a typical track circuit includes a certain number of rails, forming a given track section, which are in electrical series with a signal transmitter and a signal receiver, usually positioned at respective ends of the given track section. The signal transmitter applies a voltage to the rails, which therefore constitute the physical transmitting medium or channel; as a result, a current signal, generally in the form of a DC pulse, is transmitted through the rails and is detected by the receiver.

From a practical point of view, if the amount of the track circuit signal received is above a predefined threshold, then the relevant track is declared free of travelling trains. Conversely, when the amount of the track circuit signal received is below the predefined threshold, then the relevant track section is declared occupied by a train.

At present, a main drawback related to state-of-the-art track circuits resides in the fact that the train detection thresholds are fixed and set, by maintenance personnel, based on some track circuit conditions at a certain moment in time; e.g., during the initial calibration phase, or later during any maintenance intervention.

Unfortunately, track circuits are sensitive to operational and environmental conditions that affect the electrical characteristics of the relevant track section. For example, over time, environmental conditions and rail conditions can change and these changing conditions can affect the ballast electrical resistance between the rails of the track circuit. Consequently, leakage paths occur through the ballast, and even the leakage resistance of such leakage paths varies due to the changing conditions, thus affecting the values of the received current signals and therefore negatively influencing the possibility of correctly receiving and interpreting the signals received.

Hence, the received signals may shift with respect to the signals referenced for setting the thresholds; e.g., they may increase or decrease. If the received signal increases, then the track circuit may be operating with an excessive margin with respect to the prefixed threshold, and, in some cases, it may not properly detect the presence of trains, thus leading to safety issues. If instead the received signal decreases, then the track circuit may falsely detect the presence of trains, thus resulting in reliability issues.

Hence, in order to properly cope with these issues and trying to properly balance the requirements of safety with those of reliability, technicians are requested to intervene periodically on the field, to put the relevant track sections out of work for a certain time, to test the track circuit and then to recalibrate the thresholds set for track circuits, according to solutions which are clearly not efficient and cost effective.

SUMMARY OF THE DESCRIPTION

Hence, it is evident that there is room and desire for improvements in the way track circuits are currently used and maintained.

The present disclosure is aimed at providing a solution to this end and, in one aspect, it provides a method for estimating one or more actual electrical parameters of a track circuit including a transmitter, a receiver, and a track section interposed between the transmitter and the receiver, the method including:

- outputting by the transmitter, over said track section and towards the receiver, at least one signal including at least one data packet part;
- decoding the at least one signal received at the receiver to determine the at least one data packet received;
- generating, via a predetermined software model including a set of electrical parameters of the track circuit, one or more simulated signals by varying an actual value inputted for one or more of the set of electrical parameters included in the predetermined model, each signal generated corresponding to an actual set of values inputted for the set of electrical parameters;
- comparing each simulated signal generated with the at least one signal received at a receiver until finding at least a part of a simulated signal substantially matching with a corresponding part of the signal received at a receiver; and
- estimating as the actual electrical parameters of the track circuit the actual set of values of the electrical parameters corresponding to the simulated signal substantially matching with the at least one signal received at a receiver.

In another aspect, the present disclosure provides a system for estimating one or more actual electrical parameters of a track circuit, including at least:

a transmitter of said track circuit;

a receiver of said track circuit;

a track section of the track circuit which is interposed between the transmitter and the receiver and is suitable to transmit signals outputted by the transmitter to the receiver; and a controller;

wherein the transmitter is configured to transmit over said track section towards the receiver at least one signal including at least one data packet part;

and wherein the controller is configured to:

decode the at least one signal received at the receiver to determine the at least one data packet received;

generate, via a predetermined software model including a set of electrical parameters of the track circuit, one or more simulated signals by varying an actual value inputted for one or more of the set of electrical parameters included in the predetermined model, each signal generated corresponding to an actual set of values inputted for the set of electrical parameters;

compare each simulated signal generated with the at least one signal received at a receiver until finding at least a part of a simulated signal substantially matching with a corresponding part of the signal received at a receiver; then estimate as the actual electrical parameters of the track circuit the actual set of values of the electrical parameters corresponding to the simulated signal substantially matching with the at least one signal received at a receiver.

In a further aspect, the present disclosure provides a track circuit for a railway line including at least:

a plurality of rails coupled to form a track section having a predefined length;

a transmitter coupled to the track section at a first end of the track section and a receiver coupled to the track section at a second end of the track section, the transmitter being configured to transmit over said track section towards the receiver at least one signal including at least one data packet part, and the receiver being configured to receive the at least one signal outputted by the transmitter and transmitted via the track section; and a controller configured to:

decode the at least one signal received at the receiver to determine the at least one data packet received;

generate, via a predetermined software model including a set of electrical parameters of the track circuit, one or more simulated signals by varying an actual value inputted for one or more of the set of electrical parameters included in the predetermined model, each signal generated corresponding to an actual set of values inputted for the set of electrical parameters;

compare each simulated signal generated with the at least one signal received at a receiver until finding at least a part of a simulated signal substantially matching with a corresponding part of the signal received at a receiver; then estimate as the actual electrical parameters of the track circuit the actual set of values of the electrical parameters corresponding to the simulated signal substantially matching with the at least one signal received at a receiver.

The present disclosure also provides a computer-readable medium including software code stored therein which, when executed by a processor, execute or make execute a method including:

outputting by the transmitter, over said track section and towards the receiver, at least one signal including at least one data packet part;

decoding the at least one signal received at the receiver to determine the at least one data packet received;

generating, via a predetermined software model including a set of electrical parameters of the track circuit, one or more simulated signals by varying an actual value inputted for one or more of the set of electrical parameters included in the predetermined model, each signal generated corresponding to an actual set of values inputted for the set of electrical parameters;

comparing each simulated signal generated with the at least one signal received at a receiver until finding at least a part of a simulated signal substantially matching with a corresponding part of the signal received at a receiver; then estimating as the actual electrical parameters of the track circuit the actual set of values of the electrical parameters corresponding to the simulated signal substantially matching with the at least one signal received at a receiver.

BRIEF DESCRIPTION OF THE DRAWINGS

Detailed characteristics and advantages will become apparent from the description of some preferred but not exclusive exemplary embodiments of a method, a system, a computer-readable medium including software code and related track circuit, according to the present disclosure, illustrated only by way of non-limitative examples with the accompanying drawings, wherein.

DETAILED DESCRIPTION

Figure 1:
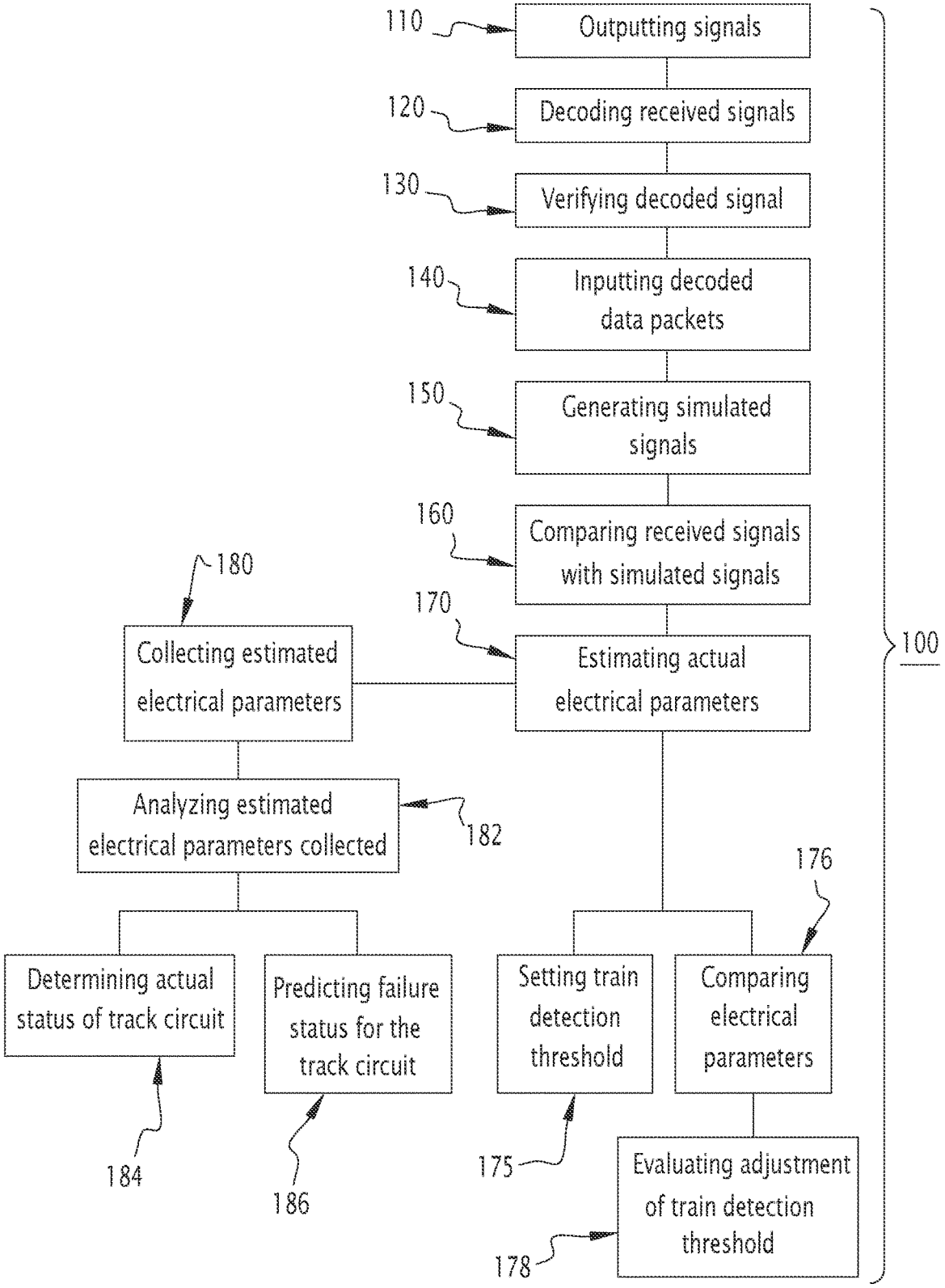
FIG. 1 is a flowchart depicting a method for estimating one or more parameters of a railway track circuit according to the present disclosure.

It should be noted that in the detailed description that follows, identical or similar components, either from a structural and/or functional point of view, may have the same reference numerals, regardless of whether they are shown in different embodiments of the present disclosure. It should be also noted that in order to clearly and concisely describe the present disclosure, the drawings may not necessarily be to scale and certain features of the disclosure may be shown in somewhat schematic form.

Further, when the term "adapted" or "arranged" or "configured" or "shaped", is used herein while referring to any component as a whole, or to any part of a component, or to a combination of components, it has to be understood that it means and encompasses correspondingly either the structure, and/or configuration and/or form and/or positioning. In particular, for electronic and/or software means, each of the above listed terms means and encompasses electronic circuits or parts thereof, as well as stored, embedded or running software codes and/or routines, algorithms, or complete programs, suitably designed for achieving the technical result and/or the functional performances for which such means are devised.

Figure 2:
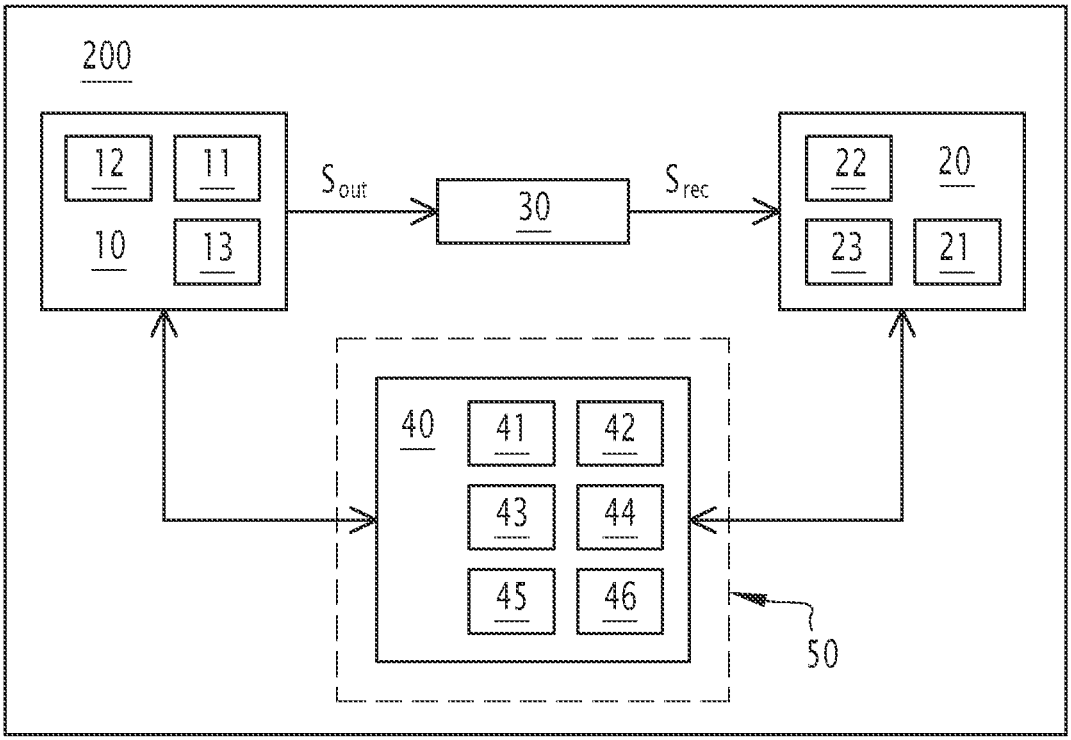
FIG. 2 is a block diagram schematically illustrating a system for estimating one or more parameters of a railway track circuit according to the present disclosure.

A method and a corresponding system for estimating parameters of a railway track circuit according to the present disclosure are illustrated in FIG. 1 and in FIG. 2, respectively, and therein indicated by the respective overall reference numbers 100 and 200.

Figure 3:
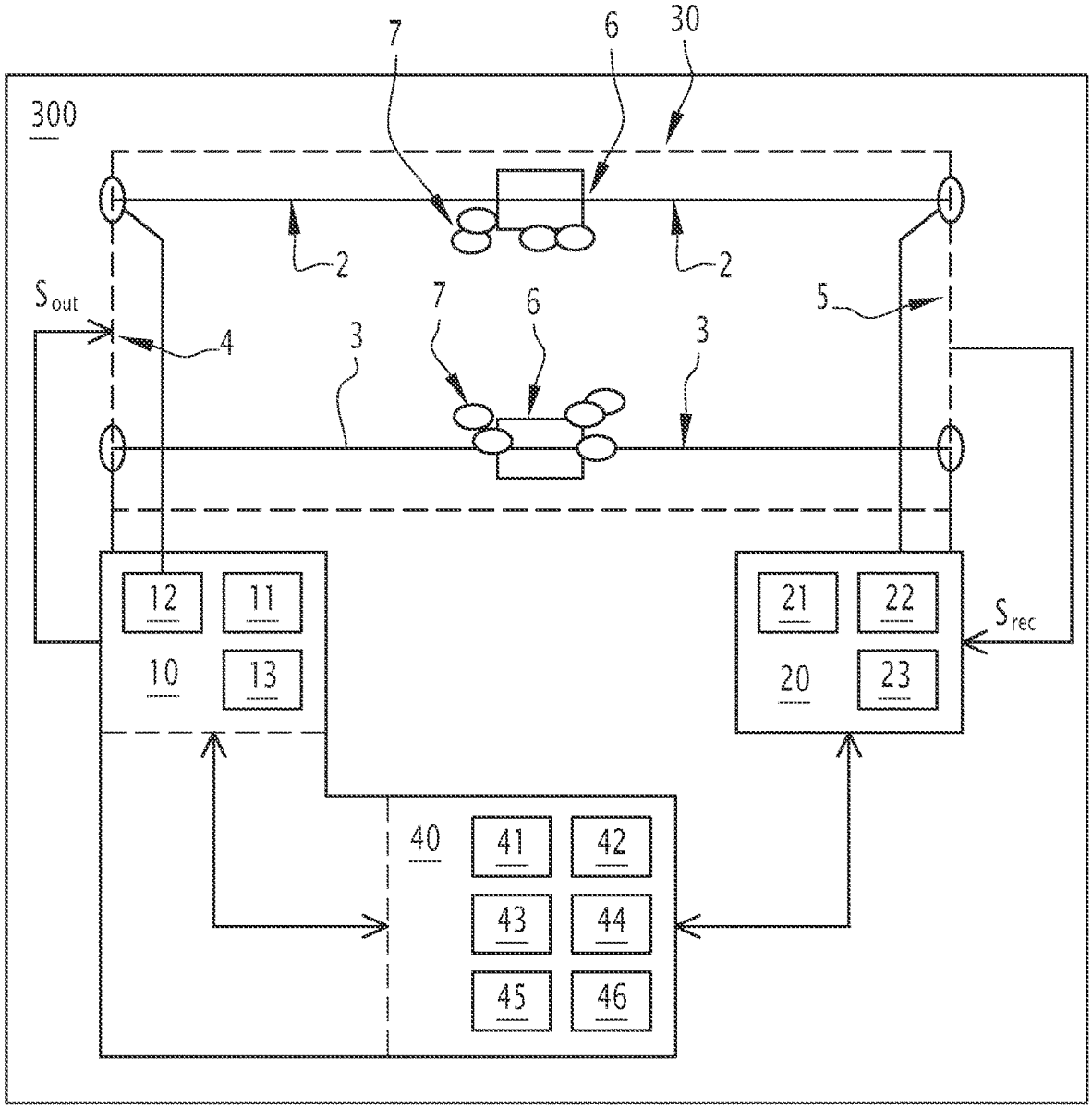
FIG. 3 schematically shows a track circuit of a railway line, according to an exemplary embodiment of the present disclosure.

Method 100 and system 200 according to the present disclosure are devised to be applied to railway track circuits, an exemplary embodiment of which is illustrated in FIG. 3 and therein indicated by the overall reference number 300.

For instance, the illustrated track circuit 300 incudes a track section 30 having a predetermined overall length L. Track section 30 includes a plurality of rails 2 and 3; rails 2 and rails 3 are arranged in parallel to form track section 30 on which a railway vehicle can run, and rails 2 and rails 3 are respectively coupled in series. Rails 2 and rails 3 form track section 30, and have a first end 4 and a second opposite end 5. For ease of illustration, in FIG. 3 there are illustrated only two rails 2 and two corresponding rails 3.

According to solutions well known in the art and therefore not described herein in details, rails 2 and rails 3 are respectively coupled to each other in sequence, for example by means of fishplates or welding, schematically represented in FIG. 3 by the reference number 6. Rails 2 are attached to rails 3 through ties, which are laid in the ground and substantially covered with ballast, i.e., small stones, to hold the ties in place. In FIG. 3, the ballast has been represented by reference number 7 only at a small area, for ease of illustration.

As illustrated, track circuit 300 includes a transmitter 10 which is coupled to track section 30, for example at or adjacent to first end 4, and a receiver 20 which is positioned for example at or adjacent to second opposite end 5. Transmitter 10 is adapted to output over track section 30 signals towards receiver 20. To this end, transmitter 10 includes for example an energy source 11 and suitable circuitry 12, adapted to generate and output over track section 30 signals $S_{out}$. In turn, receiver 20 may include an energy source 21 and suitable circuitry 22 for reception of signal $S_{rec}$ which correspond to those outputted by transmitter 10. Transmitter 10 and receiver 20 may each include a corresponding communication module; e.g., a respective transceiver 13 and 23, respectively, in data communication with each other.

As illustrated in FIG. 1, method 100 includes a first operation 110 of outputting, for example via a transmitter 10, over track section 30 and towards receiver 20, one or more signals $S_{out}$, the one or more signals $S_{out}$ including at least one data packet part.

Figure 4:
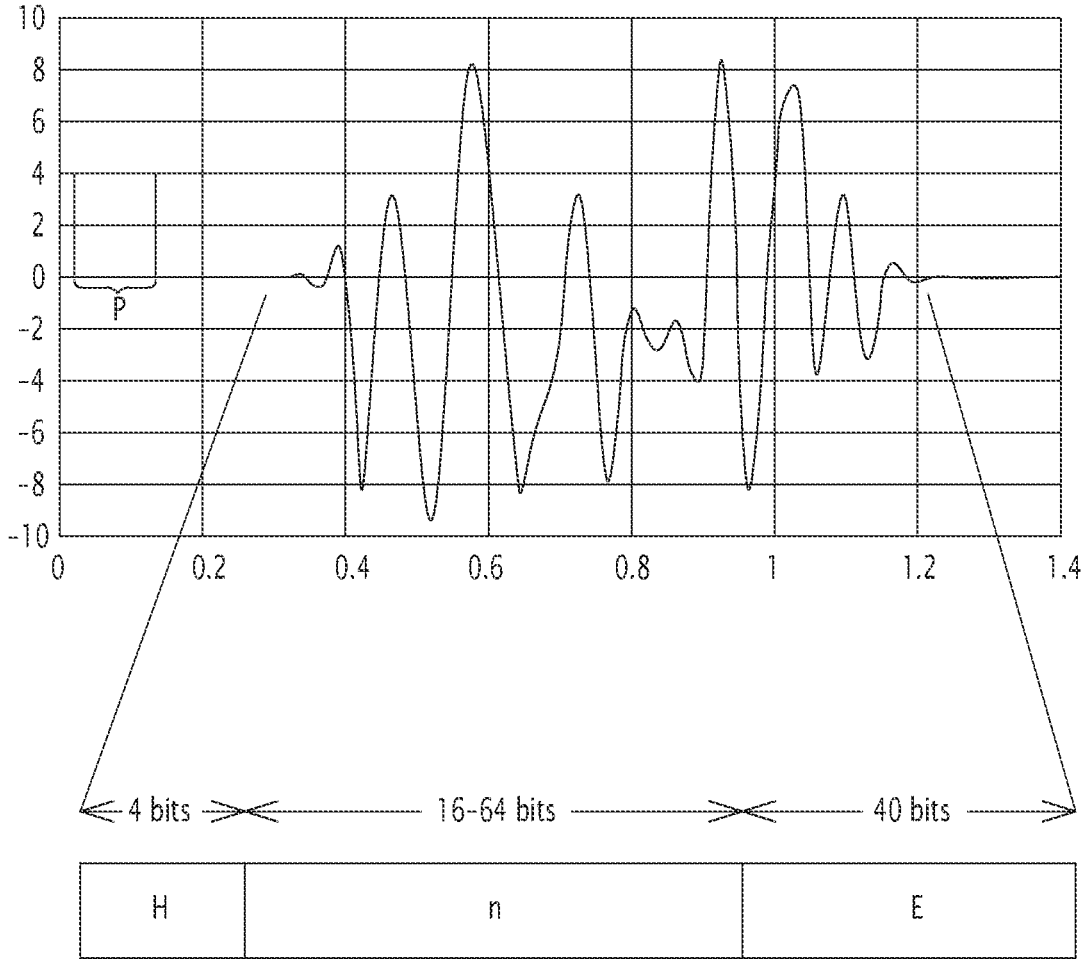
FIG. 4 is schematic graphical illustration of a signal layout outputted by a transmitter according to an exemplary embodiment of the present disclosure.

In one possible embodiment, as for example illustrated in FIG. 4, the output signal $S_{out}$ includes also a first part or precursor part P. The precursor or initial part outputted P is a DC pulse adapted for detecting the presence or absence of a train over the track circuit. Such initial output part P may also be used for detecting a broken rail or failed mechanical insulated joints, and/or for communicating some basic signal/diagnostic data. Clearly, the shape of the precursor or initial part signal P may be different from that illustrated in FIG. 4.

In one possible embodiment, the output signal $S_{out}$ includes a second part which has, for example, the shape of the waveform illustrated in FIG. 4 and includes a header part H, at least one data packet part D, and error detection part E.

The at least one data packet D carries, for example, movement authority information, such as signal aspects, and/or data related to the direction of traffic, and/or diagnostic information such as voltage/current values at one end of the track circuit, and/or data related to ballast conditions, and/or maintenance alarms such as inter alia failed signal lamp or loss of power.

In turn, error detection part E includes, for instance, one or more error detection bits adapted for identifying an error in the at least one data packet received. For example, such error detection bits are simply a type of CRC or Hash authentication code. It should be noted that any suitable integrity checking mechanisms may be used.

More specifically, at a second operation 120 of method 100, a signal received at receiver 20 is decoded to determine the at least one data packet received.

Then, at operation 150 there are generated, via a predetermined software model, one or more simulated signals. Usefully, the predetermined software model is a model simulating the track circuit 300 and includes a set of electrical parameters of the track circuit itself. The set of electrical parameters includes one or more of the electrical resistance of ballast associated with track section 30 of track circuit 300, the electrical resistance and the electrical inductance of track section 30, and in particular of rails 2 and 3 forming track section 30, the electrical resistance of one or more wires of the track circuit, for example, those for connecting transmitter 10 and receiver 20 to respective ends 4 and 5 of track section 1, and the electrical capacitance of track section 30.

In particular, the one or more simulated signals are generated, via the predetermined software model, by varying an actual value inputted for one or more of the set of electrical parameters included in the predetermined model, wherein each simulated signal generated corresponds to an actual set of values inputted for the set of electrical parameters. The various values inputted for the set of electrical parameters can be varied substantially in real time.

Further, at operation 160 each simulated signal generated is compared with the at least one signal received at receiver 20 until there is found a simulated signal which has at least one part substantially matching the corresponding part of the real signal received at receiver 20. In particular, at least the respective data packet parts are compared.

Once this matching correspondence is identified, then at operation 170 the actual set of values of the electrical parameters, corresponding to the simulated signal having at least one part substantially matching with the corresponding part of the signal $S_{rec}$ received at receiver 20, are thus identified and considered to be the actual values of the electrical parameters of track circuit 300. The matching correspondence may be evaluated according to methods readily available to those skilled in the art. For example, according to one possible method the electrical parameters are iterated until the error between received signal and simulated signal is minimized, for example using R-squared linear approximation or such other standard estimations of error between time variant signals. In another possible method the electrical parameters may be iterated in both directions until the data D start to have errors; then it is possible choose the values of the electrical parameters in the middle of the simulated range.

Figure 5:
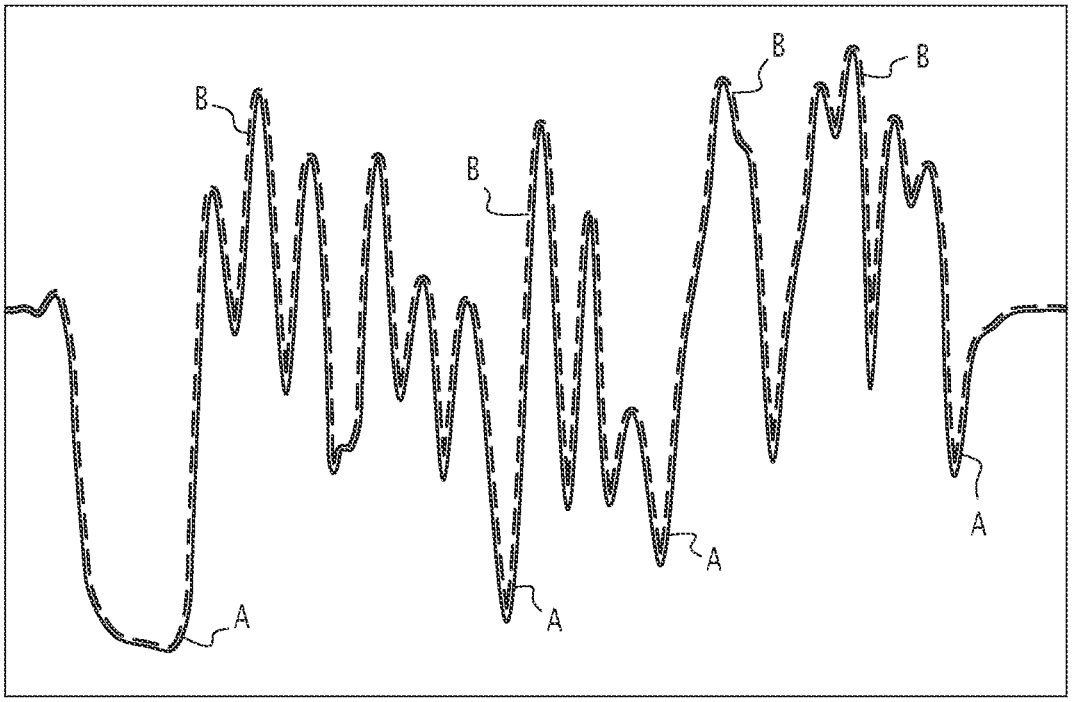
FIG. 5 shows a graphical comparison between a signal outputted by a transmitter as received at an associated receiver and a matching signal simulated via a software model of a track circuit, used in the method and system according to the present disclosure.

FIG. 5 shows a graphical comparison between a signal outputted by a transmitter as received at an associated receiver (curve A) and a matching signal (dotted curve B) simulated via the software model of a track circuit, used in the method and system according to the present disclosure. As may be seen, curves A and B substantially overlap with one another.

In one possible embodiment, in particular when the output signal $S_{out}$ includes precursor or initial part P and error detection part E, the method 100 includes an operation 130 where there is verified, by using the above mentioned error detection part E, if the at least one data packet received has been correctly decoded by matching the error detection part E to the at least one decoded data packet.

If there are identified errors, decoding is iteratively repeated, at least for a certain number of iterations, until verification operation 130 yields a positive result. Then, once the at least one data packet has been correctly decoded, at operation 140 the at least one data packet part, corresponding to the correctly decoded data packet received, is input into the predetermined software model of the track circuit. Verification operation 130 and data packet input operation 140 may be carried out, for example, after operation 120 and before operation 150 described above.

According to one possible embodiment, operation 160 includes comparing the at least one data packet part D together with error detection part E of the at least one received signal $S_{rec}$ with the corresponding data packet part and error detection part of each simulated signal generated via the predetermined software model, until an appropriate matching is found.

According to an alternative embodiment, operation 160 includes comparing precursor part P together with the at least one data packet part D of the at least one received signal $S_{rec}$ with the corresponding precursor part and data packet part of each simulated signal generated via the predetermined software model.

In practice, according to method 100, the software model of track circuit 300 allows simulation of one or more waveforms, namely one signal waveform for each combination of electrical parameters. One or more portions of these simulated waveforms are compared to the corresponding parts of the actual waveform of the signal received by receiver 10. The closest match allows evaluation of the distortions introduced into the transmitted signal, and therefore to estimate the actual set of electrical parameters of track circuit 300.

According to one possible embodiment, method 100 further incudes an operation 175 of automatically setting a train detection threshold for track circuit 300 based on the actual electrical parameters as estimated, as opposed to setting a train detection threshold based on a qualitative assessment of the electrical parameters. Alternatively, the setting of a new threshold may be triggered by an operator, and in any case be it realized automatically or via intervention of an operator, it contributes advantageously to avoid or at least reduce maintenance actions and unreliability of track circuit 300 as a whole due to the fact that the actual electrical parameters are known as opposed to a qualitative estimation of the electrical parameters.

In one possible alternative embodiment, method 100 includes an operation 176 of comparing the electrical parameters as actually estimated with the corresponding values of the same electrical parameters initially used to set the train detection threshold in place, and then evaluating, at operation 178, if the threshold should be maintained or adjusted; for example, the train detection threshold may be modified if each of the electrical parameters considered is outside a range relative to the corresponding initial parameter used, or if a selection of some parameters are outside the respective range for each parameter selected. Clearly other criteria may be used.

In one possible embodiment, method 100 further includes an operation 180 of collecting, over time, for each simulated signal substantially matching with a corresponding signal output by transmitter 10 and received at receiver 20, the respective estimated actual set of values of the electrical parameters.

According to this embodiment, method 100 further includes an operation 182 of analyzing the estimated actual sets of values of the electrical parameters collected over time and an operation 184 of determining an actual operative status of track circuit 300 or of any part thereof based on the analyzed estimated actual set of values collected over time.

According to yet another embodiment, method 100 further incudes an operation 186 of predicting a failure status for track circuit 300 or for any part thereof based on the analyzed estimated actual sets of values of the electrical parameters collected over time.

According to some possible embodiments, one or more of the above described operations of method 100 are conveniently executed via a controller 40. Controller 40 may be positioned, for example, remotely from track circuit 300, as for example schematically illustrated in FIG. 2 for system 200 where controller 40 may be positioned along the railway line associated with track circuit 300; e.g. in any trackside control location 50, or even at a remote control center supervising the entire railway line; alternatively, controller 40 may be part of track circuit 300 itself, and for example it may be included in or associated with receiver 10, as represented in the exemplary embodiment of FIG. 3.

In particular, according to an embodiment, controller 40 is configured to:

decode the at least one signal received at the receiver to determine the at least one data packet received;

generate, via the predetermined software model including a set of electrical parameters of the track circuit, one or more simulated signals by varying an actual value inputted for one or more of the set of electrical parameters included in the predetermined model, each signal generated corresponding to an actual set of values inputted for the set of electrical parameters;

compare each simulated signal generated with the at least one signal received at a receiver notably by comparing their respective data packet, until finding at least a part of a simulated signal substantially matching with a corresponding part of the signal received at a receiver; and estimate as the actual electrical parameters of the track circuit the actual set of values of the electrical parameters corresponding to the simulated signal substantially matching with the at least one signal received at a receiver.

According to an embodiment, controller 40 is further configured to:

verify, by using said error detection part, if the at least one data packet received has been correctly decoded; and, in the affirmative case; and input the at least one data packet part corresponding to the correctly decoded data packet received into the predetermined software model of the track circuit; and wherein during comparing each simulated signal generated with the at least one signal received at a receiver a data packet part of each simulated signal is compared with the data packet part of the signal received at the receiver.

According to one embodiment, controller 40 is further configured to compare the at least one data packet part together with the error detection part of the at least one signal received with the corresponding data packet part and error detection part of each simulated signal generated via the predetermined software model.

According to an alternative embodiment, controller 40 is further configured to compare the precursor part together with the at least one data packet part of the at least one signal received with the corresponding precursor part and data packet part of each simulated signal generated via the predetermined software model.

According to a possible embodiment, controller 40 is further configured to automatically set a train detection threshold for track circuit 300 based on the actual electrical parameters estimated.

According to yet a possible embodiment, controller 40 is further configured to collect over time, for each simulated signal substantially matching with a corresponding signal outputted by the transmitter and received at the receiver, the respective estimated actual set of values of the electrical parameters.

According to this embodiment, controller 40 is further configured to analyze the estimated actual sets of values of the electrical parameters collected over time and to determine an actual status of the track circuit or of any part thereof based on the analyzed estimated actual set of values collected over time, and/or to predict a failure status for the track circuit or for any part thereof based on the analyzed estimated actual sets of values of the electrical parameters collected over time.

As illustrated in the exemplary embodiments of FIGS. 2 and 3, controller 40 may include or be constituted by any processor-based device; e.g. a microprocessor, a microcontroller, a microcomputer, a programmable logic controller, an application specific integrated circuit, or any other programmable circuit, indicated in FIG. 2 by reference numeral 41. Therefore, the term processor, as used herein, is not limited to just those integrated circuits referred to in the art as computers, but broadly refers to microprocessors, microcontrollers, microcomputers, programmable logic controllers, application specific integrated circuits, and other programmable circuits, and these terms are used interchangeably herein. Further, controller 40 may include a storage unit or repository 42, e. g., a memory, for storing the determined list or table of precursor signals, a module 43 for estimating the electrical parameters, a communication module 44 for communicating outside, for example with receiver 20 and/or transmitter 10.

Further, controller 40 may include a data decoder module 45 and a checking module 46 for carrying out the above described validity check. For example, checking module 46 is configured to verify the CRC code, for instance recursively up to a predetermined number of retries, after which the process may be stopped and the signal received discarded if the verification step fails definitely.

As those skilled in the art can easily appreciate, estimating module 43, data decoder module 45, and validity check module 46 may be part of or separately associated with processor 41, and may include suitable software and any needed related circuitry according to solutions readily available. It should also be noted that, in applications where data must be transmitted in both directions, for example to support bidirectional train traffic on the same track circuit, each end of the track circuit may contain a transmitter 10, a receiver 20 and a controller 40.

As those skilled in the art will appreciate based on the foregoing description, the above-described embodiments of the disclosure may be implemented using computer programming including computer software, firmware, hardware or any combination or subset thereof, wherein data are communicated via output signals, after the signals received are decoded to reconstruct the data originally outputted via the output signals and then, by comparison with simulated waveforms, the electrical parameters of track circuit 300 are estimated. Any such resulting program, having computer-readable code means, may be embodied or provided within one or more computer-readable media, thereby making a computer program product, i.e., an article of manufacture, according to the discussed embodiments of the disclosure. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network. In practice the devised code includes software instructions which, once executed by a processor, carry out and/or cause suitable machinery and/or equipment, to carry out the various operations of method 100 as described in the foregoing description, and in particular as defined in the appended relevant claims.

Hence, it is evident that method 100, system 200, rail track circuit 300, as well as the indicated software code according to the present disclosure, enable proper and timely identification and evaluation of distortions introduced into transmitted signals by the transmission medium, namely the track section, and even of the environment around it. In this way, it is possible to timely and even automatically recalibrate track circuit 300, for example by setting a new train detection threshold. Further, with the solution provided by the present disclosure it is possible to perform more services and in a more efficient and effective way. For instance, it is possible to execute real time health monitoring and predictive maintenance operations for track circuit 300 or for any part thereof.

These results are obtained with a solution relatively easy to be implemented and in an adaptable way when the conditions of the transmission medium itself change.

Method 100, system 200, rail track circuit 300, and related software code thus conceived are susceptible of modifications and variations, all of which are within the scope of the inventive concept as defined in particular by the appended claims; for example, some parts of control system 200 or of track circuit 300, e.g. one or more of the described modules, may reside on the same electronic unit, or they may be realized as subparts of a same component or circuit of an electronic unit, or they may be placed remotely from each other and in operative communication there between; controller 40 or parts thereof may be associated with receiver 20 and/or transmitter 10. All the details may furthermore be replaced with technically equivalent elements.

What is claimed is:

1. A method for estimating one or more actual electrical parameters of a track circuit comprising a transmitter, a receiver, and a track section interposed between the transmitter and the receiver, the method comprising:

outputting by the transmitter, over the track section and towards the receiver, at least one signal comprising at least one data packet part;

decoding the at least one signal received at the receiver to determine the at least one data packet part received;

simulating one or more signals by varying an actual value input for one or more parameters of a set of electrical parameters of the track circuit, each simulated signal corresponding to an actual set of values input for the set of electrical parameters;

comparing each simulated signal generated with the at least one signal received at a receiver until finding at least a part of a simulated signal that matches a corresponding part of the signal received at the receiver; and estimating as the actual electrical parameters of the track circuit the actual set of values of the electrical parameters corresponding to the simulated signal that matches the at least one signal received at a receiver.

2. The method according to claim 1, further comprising automatically setting a train detection threshold for the track circuit based on the actual electrical parameters estimated.

3. The method according to claim 1, wherein said outputting comprises outputting the at least one signal including also a precursor part adapted to detect the presence or absence of a train along the track circuit and an error detection part, the method further comprising:

verifying, using the error detection part, if the at least one data packet received has been correctly decoded; and if said verifying is affirmative, inputting the at least one data packet part corresponding to the correctly decoded data packet received into the set of electrical parameters of the track circuit, wherein during said comparing a data packet part of each simulated signal is compared with the data packet part of the signal received at the receiver.

4. The method according to claim 3, wherein said comparing comprises comparing the at least one data packet part together with the error detection part of the at least one signal received with a corresponding data packet part and error detection part of each simulated signal.

5. The method according to claim 3, wherein said comparing comprises comparing the precursor part and the at least one data packet part of the at least one signal received with the corresponding precursor part and data packet part of each simulated signal.

6. The method according to claim 1, further comprising collecting over time, for each simulated signal matching a corresponding signal output by the transmitter and received at the receiver, the respective estimated actual set of values of the electrical parameters.

7. The method according to claim 6, further comprising:

analyzing the estimated actual sets of values of the electrical parameters collected over time; and determining an actual operative status of the track circuit or of any part thereof based on the analyzed estimated actual set of values collected over time.

8. The method according to claim 6, further comprising:

analyzing the estimated actual set of values of the electrical parameters collected over time; and predicting a failure status for the track circuit or for any part thereof based on the analyzed estimated actual sets of values of the electrical parameters collected over time.

9. A system for estimating one or more actual electrical parameters of a track circuit, comprising:

a transmitter of the track circuit;

a receiver of the track circuit;

a track section of the track circuit which is interposed between said transmitter and said receiver and is suitable to transmit signals output by said transmitter to said receiver; and a controller, wherein said transmitter is configured to transmit over said track section towards said receiver at least one signal comprising at least one data packet part, and wherein said controller is configured to:

decode the at least one signal received at said receiver to determine the at least one data packet part received;

simulate one or more signals by varying an actual value input for one or more parameters of a set of electrical parameters of the track circuit, each simulated signal corresponding to an actual set of values input for the set of electrical parameters;

compare each simulated signal generated with the at least one signal received at said receiver until finding at least a part of a simulated signal that substantially matches a corresponding part of the signal received at said receiver; and estimate as the actual electrical parameters of said track circuit the actual set of values of the electrical parameters corresponding to the simulated signal that matches the at least one signal received at said receiver.

10. The system according to claim 9, wherein said controller is configured to automatically set a train detection threshold for the track circuit based on the actual electrical parameters estimated.

11. The system according to claim 9, wherein said transmitter is configured to transmit over said track section towards said receiver the at least one signal including also a precursor part adapted to detect the presence or absence of a train along the track circuit, and an error detection part, and wherein said controller is further configured to:

verify, using the error detection part, if the at least one data packet part received has been correctly decoded; and when the verify is affirmative, input the at least one data packet part corresponding to the correctly decoded data packet received into the set of electrical parameters of the track circuit, wherein during the compare, a data packet part of each simulated signal is compared with the data packet part of the signal received at the receiver.

12. The system according to claim 11, wherein said controller is configured to compare the at least one data packet part together with the error detection part of the at least one signal received with the corresponding data packet part and error detection part of each simulated signal.

13. The system according to claim 11, wherein said controller is configured to compare the precursor part and the error detection part of the at least one signal received with the corresponding precursor part and data packet part of each simulated signal.

14. The system according to claim 9, wherein said controller is further configured to collect over time, for each simulated signal that matches a corresponding signal output by said transmitter and received by said receiver, the respective estimated actual set of values of the electrical parameters.

15. The system according to claim 14, wherein said controller is further configured to:

analyze the estimated actual sets of values of the electrical parameters collected over time, and determine an actual status of the track circuit or of any part thereof based on the analyzed estimated actual set of values collected over time.

16. The system according to claim 14, wherein said controller is configured to:

analyze the estimated actual set of values of the electrical parameters collected over time, and predict a failure status for the track circuit or for any part thereof based on the analyzed estimated actual sets of values of the electrical parameters collected over time.

17. A track circuit for a railway line, comprising at least:

a plurality of rails coupled to form a track section having a predefined length;

a transmitter coupled to said track section at a first end of said track section and a receiver coupled to said track section at a second end of said track section, the transmitter configured to transmit over said track section towards the receiver at least one signal comprising at least one data packet part, and the receiver configured to receive the at least one signal output by the transmitter and transmitted via the track section; and a controller configured to:

decode the at least one signal received at said receiver to determine the at least one data packet part received;

simulate one or more signals by varying an actual value input for one or more parameters of a set of electrical parameters of the track circuit, each simulated signal corresponding to an actual set of values input for the set of electrical parameters;

compare each simulated signal generated with the at least one signal received at said receiver until finding at least a part of a simulated signal that matches a corresponding part of the signal received at said receiver; and estimate as the actual electrical parameters of the track circuit the actual set of values of the electrical parameters corresponding to the simulated signal that matches the at least one signal received at said receiver.

18. The track circuit according to claim 17, wherein said transmitter is configured to transmit over said track section towards said receiver the at least one signal including also a precursor part adapted to detect the presence or absence of a train along the track circuit and an error detection part, wherein said controller is further configured to:

verify, using the error detection part, if the at least one data packet received has been correctly decoded; and when the verify is affirmative, input the at least one data packet part corresponding to the correctly decoded data packet received into the set of electrical parameters of the track circuit, and wherein during the compare, a data packet part of each simulated signal is compared with the data packet part of the signal received at the receiver.

19. A non-transitory computer-readable medium comprising software code stored therein which, when executed by a processor, execute or make execute a method comprising:

outputting by the transmitter, over the track section and towards the receiver, at least one signal comprising at least one data packet part;

decoding the at least one signal received at the receiver to determine the at least one data packet part received;

simulating one or more signals by varying an actual value input for one or more parameters of a set of electrical parameters of the track circuit, each signal generated corresponding to an actual set of values input for the set of electrical parameters;

comparing each simulated signal generated with the at least one signal received at a receiver until finding at least a part of a simulated signal that matches a corresponding part of the signal received at a receiver; and estimating as the actual electrical parameters of the track circuit the actual set of values of the electrical parameters corresponding to the simulated signal that matches the at least one signal received at a receiver.

* * * * *